US009695785B2

(12) United States Patent
Roth et al.

(10) Patent No.: US 9,695,785 B2
(45) Date of Patent: Jul. 4, 2017

(54) TURBOCHARGER WITH INTEGRATED VENTURI MIXER AND EGR VALVE SYSTEM

(71) Applicant: BorgWarner Inc., Auburn Hills, MI (US)

(72) Inventors: David B. Roth, Groton, NY (US); Michael Becker, Esslingen (DE); Robert Czarnowski, Oxford, MI (US); Christopher Thomas, Commerce, MI (US); Timm Kiener, Ludwigsburg (DE); Thomas Auer, Gries am Brenner (AT)

(73) Assignee: BorgWarner Inc., Auburn Hills, MI (US)

( * ) Notice: Subject to any disclaimer, the term of this patent is extended or adjusted under 35 U.S.C. 154(b) by 148 days.

(21) Appl. No.: 14/677,544

(22) Filed: Apr. 2, 2015

(65) Prior Publication Data

US 2015/0285192 A1 Oct. 8, 2015

Related U.S. Application Data

(60) Provisional application No. 61/974,024, filed on Apr. 2, 2014.

(51) Int. Cl.

| | |
|---|---|
| ***F02B 33/44*** | (2006.01) |
| ***F02M 26/04*** | (2016.01) |
| ***F02M 26/19*** | (2016.01) |
| ***F02M 26/28*** | (2016.01) |
| ***F02M 26/35*** | (2016.01) |

(52) U.S. Cl.

CPC ..... *F02M 26/04* (2016.02); *F02M 26/19* (2016.02); *F02M 26/28* (2016.02); *F02M 26/35* (2016.02)

(58) Field of Classification Search

CPC ..... F02M 26/04; F02M 26/19; F02M 26/28; F02M 26/35

See application file for complete search history.

(56) References Cited

U.S. PATENT DOCUMENTS

| | | | | |
|---|---|---|---|---|
| 6,044,827 | A * | 4/2000 | Pfaff | F02B 47/08 123/568.18 |
| 6,301,887 | B1 | 10/2001 | Gorel et al. | |
| 7,322,193 | B2 | 1/2008 | Bering et al. | |
| 7,451,750 | B1 * | 11/2008 | Fox | F02B 29/0468 123/568.12 |
| 8,015,809 | B2 * | 9/2011 | Watson | F01N 3/005 123/25 A |
| 8,960,166 | B2 * | 2/2015 | Styles | F02M 31/042 123/552 |

(Continued)

FOREIGN PATENT DOCUMENTS

| | | |
|---|---|---|
| EP | 2050949 A1 | 4/2009 |
| EP | 2202402 A2 | 6/2010 |

OTHER PUBLICATIONS

PCT/US2014/048526 Search Report and Written Opinion; Mailed Nov. 19, 2014; 14 pages.

*Primary Examiner* — Jesse Bogue
(74) *Attorney, Agent, or Firm* — BrooksGroup

(57) ABSTRACT

A number of variations may include an EGR-mixer system that may include an exhaust gas recirculation (EGR) valve and a venturi mixer. The venturi mixer may be constructed and arranged to facilitate condensation of water out of exhaust gas and/or intake air entering the EGR-mixer system.

15 Claims, 2 Drawing Sheets

(56) References Cited

U.S. PATENT DOCUMENTS

| | | | | |
|---|---|---|---|---|
| 9,382,836 | B2 * | 7/2016 | Maceroni | F02B 33/44 |
| 2004/0079079 | A1 * | 4/2004 | Martin | F01N 3/005 60/605.2 |
| 2006/0060172 | A1 * | 3/2006 | Liu | F02M 35/10118 123/568.17 |
| 2008/0022676 | A1 * | 1/2008 | Cook | F02B 29/0475 60/599 |
| 2008/0134678 | A1 * | 6/2008 | Noelle | F01D 25/24 60/605.2 |
| 2009/0071150 | A1 * | 3/2009 | Joergl | F02M 26/06 60/605.2 |
| 2010/0154758 | A1 * | 6/2010 | Schneider | G01F 1/44 123/568.12 |
| 2011/0011060 | A1 * | 1/2011 | McCarthy, Jr. | F01N 3/0814 60/274 |
| 2011/0030372 | A1 | 2/2011 | Ooshima et al. | |
| 2013/0133631 | A1 * | 5/2013 | Graze, Jr. | F02M 26/47 123/568.11 |
| 2013/0283786 | A1 * | 10/2013 | Muenz | F01D 9/026 60/605.1 |

* cited by examiner

TURBOCHARGER WITH INTEGRATED VENTURI MIXER AND EGR VALVE SYSTEM

CROSS-REFERENCE TO RELATED APPLICATION

This application claims benefit to PCT U.S. application Ser. No. 14/485,26 filed Jul. 29, 2014 which claims the benefit to U.S. Provisional Application Ser. No. 61/902,535 filed Nov. 11, 2013. Applicant also claims benefit to Provisional Application Ser. No. 61/974,024 filed Apr. 2, 2014.

TECHNICAL FIELD

The field to which the disclosure generally relates includes internal combustion engine turbochargers, exhaust gas breathing systems, and methods of making and using the same.

BACKGROUND

Exhaust gas in motor vehicles often contains water vapor that may ultimately condense and form undesirable sludge or cause damage to components of the motor vehicle. Proper management of water vapor and condensation can reduce formation of sludge and prevent damage to motor vehicle systems and components.

SUMMARY OF ILLUSTRATIVE VARIATIONS OF THE INVENTION

One variation may include an EGR-mixer system that may include an exhaust gas recirculation (EGR) valve and a venturi mixer. The venturi mixer may be constructed and arranged to facilitate condensation of water out of exhaust gas and/or intake air entering the EGR-mixer system.

Another variation may include an EGR-mixer system that may include an air inlet, an EGR valve, a venturi mixer, a condensate reservoir, and an outlet. The inlet may be constructed and arranged to guide air entering the inlet into the venturi mixer, where the venturi mixer may be constructed and arranged to facilitate condensation of water out of exhaust gas and/or intake air entering the EGR-mixer system and into the condensate reservoir, and where the outlet may guide air out of the venturi mixer.

Yet another variation may include an EGR-mixer system that may include an air inlet, an EGR valve, a venturi mixer, a condensate reservoir, an outlet, and a compressor. The inlet may be constructed and arranged to guide air entering the inlet into the venturi mixer, where the venturi mixer may be constructed and arranged to facilitate condensation of water out of exhaust gas and/or intake air entering the EGR-mixer system and into the condensate reservoir, and where the outlet may guide air out of the venturi mixer and into a compressor. The condensate reservoir may be constructed and arranged to flow condensate through a plurality of components within the system to heat or cool the components as desired.

One illustrative variation may be a product that may include a housing. The housing may include a turbocharger and a venturi mixer.

Another illustrative variation may be a product that may include a housing. The housing may include an exhaust gas recirculation (EGR) system and a venturi mixer.

Other illustrative variations within the scope of the invention will become apparent from the detailed description provided hereinafter. It should be understood that the detailed description and specific examples, while disclosing variations within the scope of the invention, are intended for purposes of illustration only and are not intended to limit the scope of the invention.

BRIEF DESCRIPTION OF THE DRAWINGS

Select examples of variations within the scope of the invention will become more fully understood from the detailed description and the accompanying drawings, wherein.

DETAILED DESCRIPTION OF ILLUSTRATIVE VARIATIONS

The following description of variants is only illustrative of components, elements, acts, products, and methods considered to be within the scope of the inventions and are not in any way intended to limit such scope by what is specifically disclosed or not expressly set forth. The components, elements, acts, products, and methods as described herein may be combined and rearranged other than as expressly described herein and still are considered to be within the scope of the inventions.

Figure 1:
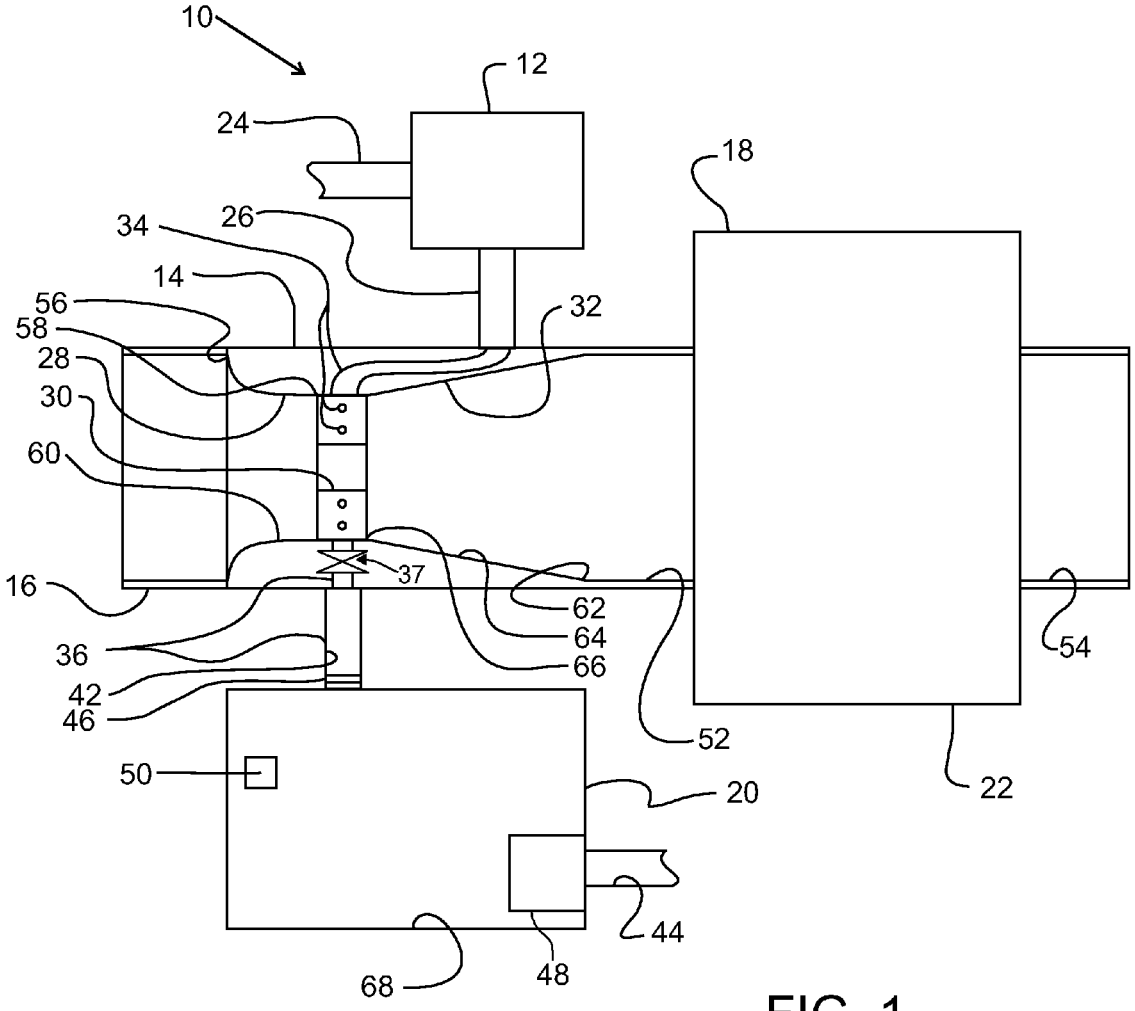
FIG. 1 illustrates a sectional view of an EGR-mixer system according to one variation.

Referring to FIG. 1, an exhaust gas recirculation (EGR) mixer (EGR-mixer) system 10 may include an EGR valve 12, a venturi mixer 14, an air intake 16, and an air outlet 18, a reservoir 20, and a compressor 22. The EGR-mixer system 10 may be constructed and arranged to facilitate the condensation of water from incoming air or exhaust gas or both.

The EGR valve 12 may have an inlet 24 where exhaust gas from a combustion engine (not shown) may through the EGR valve 12 and flow through an outlet 26. The outlet 26 may be a passage in fluid communication with the venturi mixer 14.

The venturi mixer 14 may include a converging inlet 28, a throat 30, a diverging outlet 32, an exhaust gas inlet 34, condensate outlet channels 36, heat transfer fins (not shown), and cooling channels (not shown). The converging inlet 28 may have a first circumference 56, a second circumference 58, and an entry cone portion 60, where the first circumference 56 may be larger than the second circumference 58 and the entry cone 60 may be constructed and arranged to gradually converge in the direction of fluid flow from the air intake system i.e. from the first circumference 56 to the second circumference 58. The diverging outlet 32 may have a first circumference 62, a second circumference 64, and an exit cone portion 66, where the first circumference 62 may be smaller than the second circumference 64 and the exit cone 66 may be constructed and arranged to gradually diverge in the direction of fluid flow from the air intake system i.e. from the first circumference 62 to the second circumference 64. The converging inlet 28 may be a passage in fluid communication with an air intake system (not shown) where the converging inlet 28 may gradually converge in the direction of fluid flow from the air intake system until structurally connecting to a throat 30. The throat 30 may be located at the narrowest end of the converging inlet 28. The throat 30 may be located between the converging inlet 28 and the diverging outlet 32, wherein the throat 30 may be constructed and arranged to allow fluid communication through the converging inlet 28 to the diverging outlet 32. The throat 30 may have a circumference equal to that of the second circumference 58 of the converging inlet 28 or the first circumference 62 of the diverging outlet 32, or both.

The venturi mixer 14 may also include a plurality of EGR inlet channels 34 in fluid communication with the outlet 26 of the EGR valve 12. According to one variation, the EGR inlet channels 34 may allow fluid communication between the outlet 26 of the EGR valve 12 and the converging inlet 28 of the venturi mixer 14. In another variation, the EGR inlet channels 34 may allow fluid communication between the outlet 26 of the EGR valve 12 and the throat 30 of the venturi mixer 14. In another variation, the EGR inlet channels 34 may allow fluid communication between the outlet 26 of the EGR valve 12 and the diverging outlet 32 of the venturi mixer 14.

The venturi mixer 14 may also include at least one condensate outlet channel 36 in fluid communication with a condensate reservoir 20. According to one variation, the least one condensate outlet channel 36 may allow fluid communication between the converging inlet 28 of the venturi mixer 14 and the reservoir 20. In another variation, the least one condensate outlet channel 36 may allow fluid communication between the throat 30 of the venturi mixer 14 and the reservoir 20. In another variation, the least one condensate outlet channel 36 may allow fluid communication between the diverging outlet 32 of the venturi mixer 14 and the reservoir 20.

The venturi mixer 14 may also include at least one heat transfer fin (not shown) constructed and arranged to function as a passive heat exchanger. The at least one heat transfer fin may be located within the converging inlet 28, the throat 30, or the diverging outlet 32, or any combination of the converging inlet 28, throat 30, and diverging 32. The venturi mixer 14 may also include at least one cooling channel (not shown) constructed and arranged to function as an active heat exchanger. The at least one cooling channel may be located within the converging inlet 28, the throat 30, or the diverging outlet 32, or any combination of the converging inlet 28, throat 30, and diverging 32. A cooling fluid may be flown through the at least one cooling channel to cool the venturi mixer 14.

The venturi mixer 14 may be constructed and arranged to facilitate the condensation of water from incoming air or exhaust gas or both wherein the converging inlet 28 and the EGR valve 12 may be constructed and arranged to flow air and exhaust gas into the venturi mixer 14, and wherein the air and exhaust gas may mix and flow from the converging inlet 28 through the throat 30 and through the diverging outlet 32 causing moisture within the air and exhaust gas mixture to condensate and fall out of the air and exhaust gas mixture.

The condensate reservoir 20 may have an inlet 42, an outlet 44, a filter 46, a pump 48, a fluid reservoir 68, and a water level sensor 50. The inlet 42 may be in fluid communication with the at least one condensate outlet channel 36 of the venturi mixer 14. The fluid reservoir 68 may be constructed and arranged to contain and hold condensate or other fluids. In one variation, condensate flowing from the venturi mixer 14, through the at least one condensate outlet channel 36, and into the inlet 42 may be collected in the fluid reservoir 68. In another variation, the pump 48 may be constructed and arranged to flow condensate from the fluid reservoir 68 through the outlet 44 and into the at least one cooling channel of the venturi mixer 14. The filter 46 may be located within the inlet 42, the outlet 44, or anywhere within the fluid reservoir 68 and may be constructed and arranged to filter particulate from incoming or outgoing fluid or condensate. The water level sensor 50 may be constructed and arranged to monitor fluid or condensate levels within the fluid reservoir 68.

The compressor 22 may have an inlet 52 and an outlet 54. The inlet 52 may be in fluid communication with the diverging outlet 32 of the venturi mixer 14, and the outlet 54 may be in fluid communication and a combustion engine (not shown). The compressor 22 may be constructed and arranged to flow fluid from the venturi mixer 14 to a combustion engine.

FIG. 1 is only one illustrative variation and it should be understood that discloses optional variations of the invention and is intended for purposes of illustration only and is not intended to limit the scope of the invention.

Figure 2:
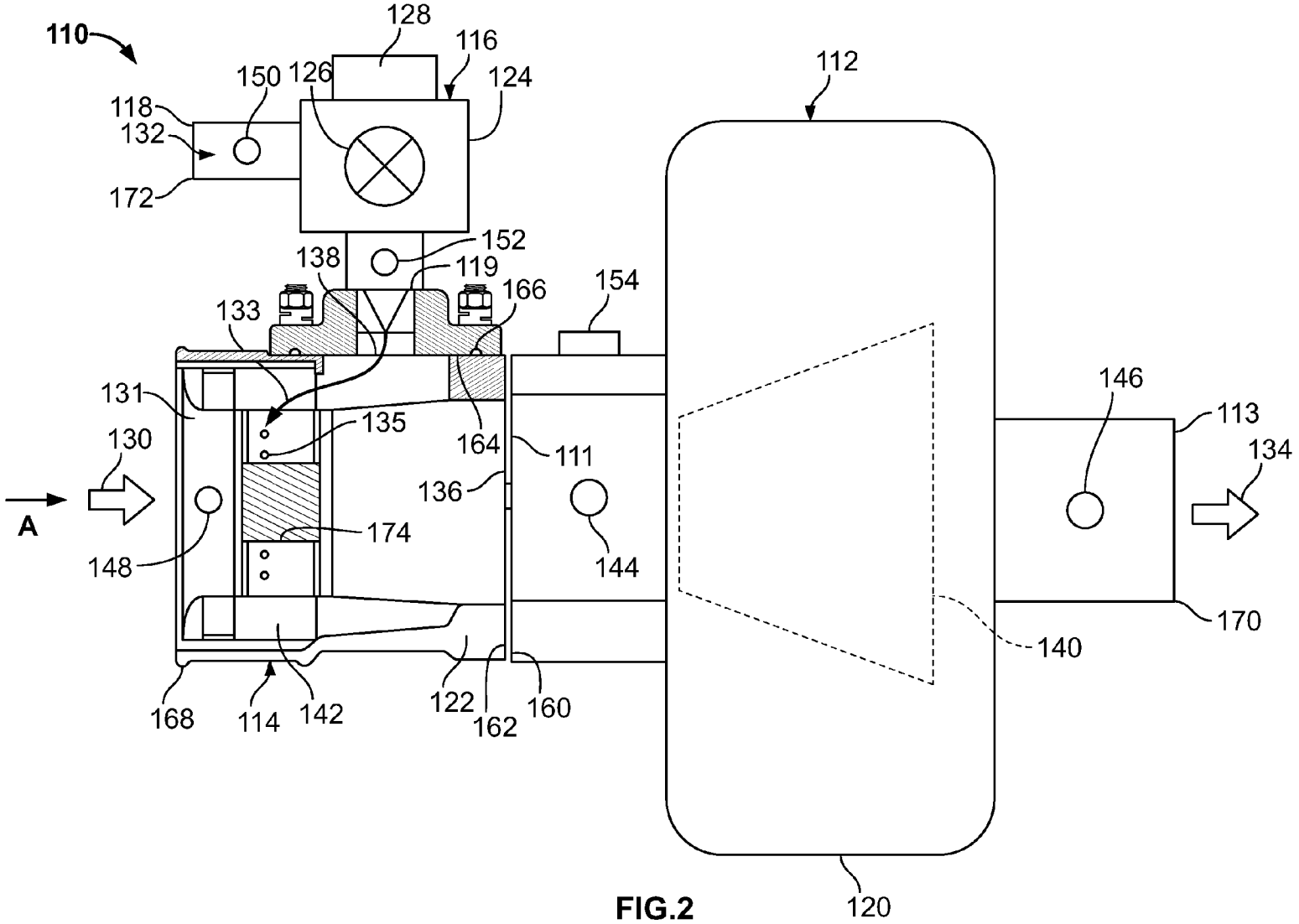
FIG. 2 illustrates a variation including a turbocharger assembly with an integrated venturi mixer and EGR valve.

Referring to FIG. 2; a turbocharger assembly 110 may include a compressor 112, a venturi mixer 114, and an EGR valve 116.

The compressor 112 may include a housing 120, a compressor wheel 140, a venturi interface 160, and one or more sensors 144, 146 disposed within the housing. The one or more sensors 144, 146 may measure oxygen levels, pressures, temperatures and/or turbocharger speed. One or more of the sensors may be a wide-band oxygen sensor. The housing 120 may include a venturi interface 160 and an exhaust gas breathing system interface 170 and may define an inlet port 111 and an outlet port 113. The housing 120 may be made of metal or any other material suitable for high temperature environments.

The venturi mixer 114 may include a housing 122, a venturi tube 142, and one or more sensors 148 to measure oxygen levels, pressures, and/or temperatures within the venturi housing 122. The housing 122 may include a compressor interface 162, an EGR interface 164, and an exhaust gas breathing system interface 168, and may define an intake air flow inlet port 131, an exhaust gas flow inlet port 138, and an outlet port 136. The venturi tube 142 may have an internal circumference that gradually converges in axial direction A towards a throat 174 and gradually diverges in axial direction A and may be constructed and arranged to create a venturi effect at the throat 174 for the particular internal combustion engine and exhaust gas breathing system in which it is being used. The venturi tube 142, together with the venturi housing 122, may define a path for exhaust gas flow 133 though one or more orifices 135 which may be formed in the venturi tube 142 and may be disposed around the circumference of the venturi tube 142, which may allow exhaust gas flow 133 into venturi intake air flow 130. The housing 122 may be made of metal or any other material suitable for high temperature environments.

In one variation, the venturi tube 142 may be an insert placed within the housing 122 and may be made of metal or any other material suitable for high temperature environments. In other variations, the venturi tube 142 may be cast, molded, and/or machined into the housing 122 and may be made of metal or any other material suitable for high temperature environments.

The EGR valve 116 may include a housing 124, a valve 126, a valve actuator 128, and sensors 150, 152 that may measure intake oxygen levels, pressures, and/or temperatures, disposed within the EGR valve housing 124. The housing 124 may include a venturi mixer interface 166 and an exhaust gas breathing system interface 172 and may define an inlet port 118 and an outlet port 119. The housing 124 may be made of metal or any other material suitable for high temperature environments.

In one variation, turbocharger assembly 110 may include a compressor housing 120 and venturi mixer housing 122 connected at interfaces 160, 162 and may include attaching the venturi mixer housing 122 to the EGR housing 124 at interfaces 164, 166 using fasteners, welds, adhesives, or any other suitable attachment means. In another variation, turbocharger assembly 110 may be a one-piece housing including housing 120, housing 122, and housing 124 all being inter-connected. In another variation, the turbocharger assembly 110 may be a one-piece housing including housing 120, housing 122, and housing 124 attached at interfaces 164, 166 using fasteners, welds, adhesives, or any other suitable attachment means. In yet another variation, the turbocharger assembly 110 may be a one-piece construct that may include housing 122, housing 124, and housing 120 attached at interfaces 160, 162 using fasteners, welds, adhesives, or any other suitable attachment means.

In another variation, an integrated electrical connector 154 may be attached to the housing 120, 122, or 124 of the turbocharger assembly 110 and may provide a single electrical connector for one or more of sensors 144, 146, 148, 150, 152, and valve actuator 128.

In another variation, sensors 144, 146, 148, 150, and 152 may be wide-band oxygen sensors.

FIG. 2 is only one illustrative variation and it should be understood that discloses optional variations of the invention and is intended for purposes of illustration only and is not intended to limit the scope of the invention.

According to a first variation, an EGR-mixer system may include a venturi mixer that may include a converging inlet, a throat, and a diverging outlet, and where the converging inlet, throat, and diverging outlet may define a through-channel within the venturi mixer and where the venturi mixer may be constructed and arranged to facilitate the mixing of incoming exhaust gas flow and incoming air flow to create an exhaust gas and air mixture that flows through the through-channel and to facilitate condensation of liquid from the exhaust gas and air mixture as said mixtures flows through the through-channel of the venturi mixer.

A second variation may include an EGR-mixer system as set forth in the first variation where the converging inlet may converge at an angle ranging from about 1 degree to about 30 degrees relative to a longitudinal axis of the through-channel and where the diverging inlet may diverge at an angle ranging from about 1 degree to about 9 degrees relative to the longitudinal axis of the through-channel.

A third variation may include an EGR-mixer system as set forth in the first or second variations where the EGR-mixer system may further include a reservoir, the reservoir that may include an inlet, a fluid reservoir, and a pump. The reservoir may be constructed and arranged to receive condensate from the venturi mixer and may flow said condensate to at least one portion of a motor vehicle to actively cool or heat that portion of the motor vehicle.

A fourth variation may include an EGR-mixer system as set forth in the first through third variations where the venturi mixer may further include at least one exhaust gas inlet channel that may be constructed and arranged to facilitate the mixing of incoming exhaust gas flow and incoming air flow to create an exhaust gas and air mixture.

A fifth variation may include an EGR-mixer system as set forth in the first through fourth variations where the venturi mixer may further include at least one heat transfer fin that may be constructed and arranged to facilitate passive cooling of the venturi mixer and condensation of liquid from the exhaust gas and air mixture as said mixture flows through the through-channel of the venturi mixer.

A sixth variation may include an EGR-mixer system as set forth in the first through fifth variations where the venturi mixer may further include at least one cooling channel that may be constructed and arranged to facilitate active cooling of the venturi mixer and condensation of liquid from the exhaust gas and air mixture as said mixtures flows through the through-channel of the venturi mixer.

A seventh variation may include an EGR-mixer system as set forth in the third variation where the venturi mixer may further include at least one cooling channel and the reservoir may be constructed and arranged to receive condensate from the venturi mixer and flow said condensate to the at least one cooling channel constructed and arranged to facilitate active cooling of the venturi mixer.

An eighth variation may include an EGR-mixer system as set forth in the first through seventh variations where the converging inlet may include a first circumference, a second circumference, and an entry cone portion, where the first circumference may be larger than the second circumference and the entry cone may be constructed and arranged to gradually converge from the first circumference to the second circumference along the length of the entry cone. The diverging outlet may comprise a first circumference, a second circumference, and an exit cone portion, where the first circumference may be smaller than the second circumference and the exit cone may be constructed and arranged to gradually diverge from the first circumference to the second circumference along the length of the exit cone. The throat may be positioned between the second circumference of the converging inlet and the first circumference of the diverging outlet and may structurally connect to two. The throat may be constructed and arranged to allow fluid communication between the converging inlet and the diverging outlet. The second circumference of the converging inlet and the first circumference of the diverging outlet may be equal.

A ninth variation may include an EGR-mixer system as set forth in the first through eighth variations and may include a compressor that may include an inlet and an outlet where the inlet may be in fluid communication with the diverging outlet of the venturi mixer and the outlet may be in fluid communication with a combustion engine. The compressor may be constructed and arranged to flow fluid from the venturi mixer to the combustion engine.

A tenth variation may include an EGR-mixer system that may include a venturi mixer and an EGR valve. The venturi mixer may include a converging inlet, a throat, a diverging outlet, at least one exhaust gas EGR inlet channel, and at least one cooling channel. The EGR valve may include an inlet, a valve, and an outlet. The inlet may be constructed and arranged to receive exhaust gas from a combustion engine and the valve may be positionable to adjust the flow of exhaust gas through the inlet and outlet, and the outlet may be constructed and arranged to allow exhaust gas to flow from the EGR valve to the at least one EGR inlet channel of the venturi mixer. The at least one EGR inlet channel may be constructed and arranged to facilitate the flow of incoming exhaust gas flow from the EGR valve into the venturi mixer. The converging inlet may be constructed and arranged to facilitate intake of air from an air intake and flow said air to the throat. The throat may connect the converging inlet to the diverging outlet. The diverging outlet may be constructed and arranged to facilitate the flow of the exhaust gas and air from the converging inlet and throat to an outlet. The venturi mixer may constructed and arranged to mix exhaust gas and incoming air flow to create an exhaust gas and air mixture and to facilitate condensation of liquid from the exhaust gas and air mixture as said mixtures flows through the venturi mixer.

An eleventh variation may include an EGR-mixer system as set tenth variation where the converging inlet may converge at an angle ranging from about 1 degree to about 30 degrees relative to a longitudinal axis of the through-channel and where the diverging inlet may diverge at an angle ranging from about 1 degree to about 9 degrees relative to the longitudinal axis of the through-channel.

A twelfth variation may include an EGR-mixer system as set forth in the tenth through eleventh variations where the EGR-mixer system may further include a reservoir. The reservoir may comprise an inlet, a fluid reservoir, and a pump. The reservoir may be constructed and arranged to receive condensate from the venturi mixer and may flow said condensate to at least one portion of a motor vehicle to actively cool or heat that portion of the motor vehicle.

A thirteenth variation may include an EGR-mixer system as set forth in the tenth through twelfth variations where the venturi mixer may further include at least one heat transfer fin that may be constructed and arranged to facilitate passive cooling of the venturi mixer and condensation of liquid from the exhaust gas and air mixture as said mixtures flows through the through-channel of the venturi mixer.

A fourteenth variation may include an EGR-mixer system as set forth in the tenth through thirteenth variations where the venturi mixer may further include at least one cooling channel that may be constructed and arranged to facilitate active cooling of the venturi mixer and condensation of liquid from the exhaust gas and air mixture as said mixtures flows through the through-channel of the venturi mixer.

A fifteenth variation may include an EGR-mixer system as set forth in the tenth through fourteenth variations where the venturi mixer may further include at least one cooling channel and the reservoir may be constructed and arranged to receive condensate from the venturi mixer and flow said condensate to the at least one cooling channel constructed and arranged to facilitate active cooling of the venturi mixer.

A sixteenth variation may include an EGR-mixer system that may include a venturi mixer, an EGR valve, an air intake, an air outlet, a reservoir, and a compressor. The venturi mixer may include a converging inlet, a throat, a diverging outlet, at least one exhaust gas EGR inlet channel, and at least one cooling channel. The EGR valve may include an inlet, a valve, and an outlet. The inlet may be constructed and arranged to receive exhaust gas from a combustion a engine, the valve may be positionable to adjust the flow of exhaust gas through the inlet and outlet, and the outlet may be constructed and arranged to allow exhaust gas to flow from the EGR valve to the at least one EGR inlet channel of the venturi mixer. The at least one EGR inlet channel may be constructed and arranged to facilitate the flow of incoming exhaust gas flow from the EGR valve into the venturi mixer. The converging inlet, throat, and diverging outlet may define a through-channel within the venturi mixer. The converging inlet may be constructed and arranged to facilitate intake of air from an air intake and float said air to the throat. The throat may connect the converging inlet to the diverging outlet. The diverging outlet may be constructed and arranged to facilitate the flow of the exhaust gas and air from the converging inlet and throat to the air outlet in fluid communication with the compressor. The venturi mixer may be constructed and arranged to mix exhaust gas and incoming air flow to create an exhaust gas and air mixture and to facilitate condensation of liquid from the exhaust gas and air mixture as said mixture flows through the through-channel of the through-channel of the venturi mixer. The compressor may include an inlet for receiving the exhaust gas and air mixture from the venturi mixer and an outlet in fluid communication with a combustion engine. The at least one condensate outlet channel may be constructed and arranged to collect and flow condensate to the reservoir and the at least one cooling channel may be constructed and arranged to actively cool the venturi mixer via an active cooling system.

A seventeenth variation may include an EGR-mixer system as set forth in the sixteenth variation where the converging inlet may converge at an angle ranging from about 1 degree to about 30 degrees relative to a longitudinal axis of the through-channel and where the diverging inlet may diverge at an angle ranging from about 1 degree to about 9 degrees relative to the longitudinal axis of the through-channel.

An eighteenth variation may include an EGR-mixer system as set forth in the sixteenth through seventeenth variations further including a reservoir. The reservoir may include an inlet, a fluid reservoir, and a pump; and the reservoir may be constructed and arranged to receive condensate from the venturi mixer and flow said condensate to at least one portion of a motor vehicle to actively cool or heat that portion of the motor vehicle.

A nineteenth variation may include an EGR-mixer system as set forth in the sixteenth through eighteenth variations that may further include at least one heat transfer fin that may be constructed and arranged to facilitate passive cooling of the venturi mixer and condensation of liquid from the exhaust gas and air mixture as said mixtures flows through the through-channel of the venturi mixer.

A twentieth variation may include an EGR-mixer system as set forth in the sixteenth through nineteenth variations that may further include at least one cooling channel that may be constructed and arranged to facilitate active cooling of the venturi mixer and condensation of liquid from the exhaust gas and air mixture as said mixtures flows through the through-channel of the venturi mixer.

According to a twenty-first variation, a product may include a housing, a turbocharger, and a venturi mixer.

A twenty second variation may include a product as set forth in the twenty-first variation wherein the housing is a single-piece construction wherein the housing, the turbocharger, and venturi mixer are interconnected.

A twenty third variation may include a product as set forth in the twenty first through twenty second variations that may further include an EGR valve wherein the EGR valve may be a part of the single-piece construction housing.

A twenty fourth variation may include a product as set forth in the twenty first through twenty third variations wherein the turbocharger and the venturi mixer may be of a single-piece construction.

A twenty fifth variation may include a product as set forth in the twenty first through twenty fourth variations wherein the housing may be a first housing; the turbocharger may include a second housing; the venturi mixer may include a third housing and wherein the first housing may include a body portion and the body portion may define both the second housing and the third housing such that the first housing, second housing, and third housing may be of a single piece construction.

A twenty sixth variation may include a product as set forth in the twenty first through twenty fifth variations wherein the venturi mixer may further include a venturi tube insert disposed within the housing.

A twenty seventh variation may include a product as set forth in the twenty first through twenty sixth variations wherein the venturi mixer may further define a venturi tube disposed within the housing wherein the venturi mixer and the venturi tube may be of a single-piece construction.

A twenty eighth variation may include a product as set forth in the twenty first through twenty seventh variations that may further include one or more of oxygen sensors, temperature sensors, pressure sensors, or turbocharger speed sensors disposed within the housing.

A twenty ninth variation may include a product as set forth in the twenty first through twenty eighth variations that may further include an integrated electrical connector in communication with the housing to provide a single electrical connector for the sensors.

A thirtieth variation may include an EGR valve and a venturi mixer wherein the EGR valve and the venturi mixer are constructed and arranged to form an integrated housing.

A thirty first variation may include a product as set forth in the thirtieth variation that may further include a compressor wherein the compressor may be an integrated portion of the integrated housing.

A thirty second variation may include a product as set forth in the thirtieth and thirty first variations wherein the EGR valve and the venturi mixer may be of a single piece construction.

A thirty third variation may include a product as set forth in the thirtieth through thirty second variations that may further include a compressor, a venturi mixer, and an EGR valve; wherein the compressor, the venturi mixer, and the EGR valve are constructed and arranged to form an integrated housing.

A thirty fourth variation may include a product as set forth in the thirtieth through thirty third variations that may further include one or more sensors disposed within the integrated housing, an EGR valve actuator, and an integrated electrical connector in communication with the sensors and valve actuator.

A thirty fifth variation may include a product as set forth in the thirtieth through thirty fourth variations wherein one or more of the sensors may include an oxygen sensor, temperature sensor, pressure sensor, or turbocharger speed sensor.

A thirty sixth variation may include a product that may include a first housing, a venturi mixer, and an EGR valve. The venturi mixer may include a second housing, a converging inlet, a throat, a diverging outlet, at least one exhaust gas EGR inlet channel, and at least one cooling channel. The EGR valve may include a third housing, an inlet, a valve, and an outlet. The inlet may be constructed and arranged to receive exhaust gas from a combustion engine and the valve may be positionable to adjust the flow of exhaust gas through the inlet and outlet, and the outlet may be constructed and arranged to allow exhaust gas to flow from the EGR valve to the at least one EGR inlet channel of the venturi mixer. The at least one EGR inlet channel may be constructed and arranged to facilitate the flow of incoming exhaust gas flow from the EGR valve into the venturi mixer. The converging inlet may be constructed and arranged to facilitate intake of air from an air intake and flow said air to the throat. The throat may connect the converging inlet to the diverging outlet. The diverging outlet may be constructed and arranged to facilitate the flow of the exhaust gas and air from the converging inlet and throat to an outlet. The venturi mixer may constructed and arranged to mix exhaust gas and incoming air flow to create an exhaust gas and air mixture and to facilitate condensation of liquid from the exhaust gas and air mixture as said mixtures flows through the venturi mixer.

An thirty seventh variation may include an EGR-mixer system as set forth in the thirty sixth variation where the venturi mixer may further include at least one exhaust gas inlet channel that may be constructed and arranged to facilitate the mixing of incoming exhaust gas flow and incoming air flow to create an exhaust gas and air mixture.

A thirty eighth variation may include a product as set forth in the thirty sixth through thirty seventh variations wherein the EGR valve and the venturi mixer may be of a single piece construction.

A thirty ninth variation may include a product as set forth in the thirty sixth through thirty eighth variations wherein the first housing may define both the second housing and the third housing and may be constructed and arranged such that the first housing, second housing, and third housing may be of a single piece construction.

The above description of variations of the invention is merely demonstrative in nature and, thus, variations thereof are not to be regarded as a departure from the spirit and scope of the inventions disclosed within this document.

What is claimed is:

1. A product comprising:

an EGR-mixer system comprising a venturi mixer and an EGR valve;

the venturi mixer comprising a converging inlet, a throat, a diverging outlet, at least one exhaust gas EGR inlet channel, and at least one cooling channel;

the EGR valve comprising an inlet, a valve, and an outlet, the inlet constructed and arranged to receive exhaust gas from a combustion an engine, the valve being positionable to adjust the flow of exhaust gas through the inlet and outlet, and the outlet constructed and arranged to allow exhaust gas to flow from the EGR valve to the at least one EGR inlet channel of the venturi mixer;

the at least one EGR inlet channel being constructed and arranged to facilitate the flow of incoming exhaust gas flow from the EGR valve into the venturi mixer;

the converging inlet being constructed and arranged to facilitate intake of air from an air intake and flow said air to the throat;

the throat connecting the converging inlet to the diverging outlet;

the diverging outlet being constructed and arranged to facilitate the flow of the exhaust gas and air from the converging inlet and throat to an outlet; and wherein the venturi mixer is constructed and arranged to mix exhaust gas and incoming air flow to create an exhaust gas and air mixture and to facilitate condensation of liquid from the exhaust gas and air mixture as said mixtures flows through the venturi mixer.

2. A product as set forth in claim 1, wherein:

the converging inlet converges at an angle ranging from 1 degree to 30 degrees relative to a longitudinal axis of the through-channel; and the diverging outlet diverges at an angle ranging from 1 degree to 9 degrees relative to the longitudinal axis of the through-channel.

3. A product as set forth in claim 1, wherein:

the EGR-mixer system further comprises a reservoir, the reservoir comprising an inlet, a fluid reservoir, and a pump; and wherein the reservoir is constructed and arranged to receive condensate from the venturi mixer and flow said condensate to at least one portion of a motor vehicle to actively cool or heat that portion of the motor vehicle.

4. A product as set forth in claim 1, wherein:

the venturi mixer further comprises at least one heat transfer fin constructed and arranged to facilitate passive cooling of the venturi mixer and condensation of liquid from the exhaust gas and air mixture as said mixtures flows through the through-channel of the venturi mixer.

5. A product as set forth in claim 1, wherein:

the venturi mixer further comprises at least one cooling channel constructed and arranged to facilitate active cooling of the venturi mixer and condensation of liquid from the exhaust gas and air mixture as said mixtures flows through the through-channel of the venturi mixer.

6. A product as set forth in claim 3, wherein:

the venturi mixer further comprises at least one cooling channel; and the reservoir is constructed and arranged to receive condensate from the venturi mixer and flow said condensate to the at least one cooling channel constructed and arranged to facilitate active cooling of the venturi mixer.

7. A product comprising:

an EGR-mixer system comprising a venturi mixer, an EGR valve, an air intake, an air outlet, a reservoir, and a compressor;

the venturi mixer comprising a converging inlet, a throat, a diverging outlet, at least one exhaust gas EGR inlet channel, and at least one cooling channel;

the EGR valve comprising an inlet, a valve, and an outlet, the inlet constructed and arranged to receive exhaust gas from a combustion a engine, the valve being positionable to adjust the flow of exhaust gas through the inlet and outlet, and the outlet being constructed and arranged to allow exhaust gas to flow from the EGR valve to the at least one EGR inlet channel of the venturi mixer;

the at least one EGR inlet channel being constructed and arranged to facilitate the flow of incoming exhaust gas flow from the EGR valve into the venturi mixer;

the converging inlet, throat, and diverging outlet defining a through-channel within the venturi mixer;

the converging inlet being constructed and arranged to facilitate intake of air from an air intake and float said air to the throat;

the throat connecting the converging inlet to the diverging outlet;

the diverging outlet being constructed and arranged to facilitate the flow of the exhaust gas and air from the converging inlet and throat to the air outlet in fluid communication with the compressor;

wherein the venturi mixer is constructed and arranged to mix exhaust gas and incoming air flow to create an exhaust gas and air mixture and to facilitate condensation of liquid from the exhaust gas and air mixture as said mixture flows through the through-channel of the through-channel of the venturi mixer;

the compressor comprising an inlet for receiving the exhaust gas and air mixture from the venturi mixer and an outlet in fluid communication with a combustion engine; and wherein the at least one condensate outlet channel is constructed and arranged to collect and flow condensate to the reservoir and the at least one cooling channel is constructed and arranged to actively cool the venturi mixer via an active cooling system.

8. A product as set forth in claim 1, wherein:

the converging inlet converges at an angle ranging from 1 degree to 30 degrees relative to a longitudinal axis of the through-channel; and the diverging outlet diverges at an angle ranging from 1 degree to 30 degrees relative to the longitudinal axis of the through-channel.

9. A product as set forth in claim 7, wherein:

the EGR-mixer system further comprises a reservoir, the reservoir comprising an inlet, a fluid reservoir, and a pump; and wherein the reservoir is constructed and arranged to receive condensate from the venturi mixer and flow said condensate to at least one portion of a motor vehicle to actively cool or heat that portion of the motor vehicle.

10. A product as set forth in claim 7, wherein:

the venturi mixer further comprises at least one heat transfer fin constructed and arranged to facilitate passive cooling of the venturi mixer and condensation of liquid from the exhaust gas and air mixture as said mixtures flows through the through-channel of the venturi mixer.

11. A product as set forth in claim 7, wherein:

the venturi mixer further comprises at least one cooling channel constructed and arranged to facilitate active cooling of the venturi mixer and condensation of liquid from the exhaust gas and air mixture as said mixtures flows through the through-channel of the venturi mixer.

12. A product comprising:

an EGR-mixer system comprising a first housing, a venturi mixer, an EGR valve, an air intake, an air outlet, a reservoir, and a compressor;

the venturi mixer comprising a second housing, a converging inlet, a throat, a diverging outlet, at least one exhaust gas EGR inlet channel, and at least one cooling channel;

the EGR valve comprising a third housing, an inlet, a valve, and an outlet, the inlet constructed and arranged to receive exhaust gas from a combustion engine, the valve being positionable to adjust the flow of exhaust gas through the inlet and outlet, and the outlet being constructed and arranged to allow exhaust gas to flow from the EGR valve to the at least one EGR inlet channel of the venturi mixer;

the at least one EGR inlet channel being constructed and arranged to facilitate the flow of incoming exhaust gas flow from the EGR valve into the venturi mixer;

the converging inlet, throat, and diverging outlet defining a through-channel within the venturi mixer;

the converging inlet being constructed and arranged to facilitate intake of air from an air intake and float said air to the throat, the throat connecting the converging inlet to the diverging outlet;

the diverging outlet being constructed and arranged to facilitate the flow of the exhaust gas and air from the converging inlet and throat to the air outlet in fluid communication with the compressor;

wherein the venturi mixer is constructed and arranged to mix exhaust gas and incoming air flow to create an exhaust gas and air mixture and to facilitate condensation of liquid from the exhaust gas and air mixture as said mixture flows through the through-channel of the through-channel of the venturi mixer;

the compressor comprising an inlet for receiving the exhaust gas and air mixture from the venturi mixer and an outlet in fluid communication with a combustion engine; and wherein the at least one condensate outlet channel is constructed and arranged to collect and flow condensate to the reservoir and the at least one cooling channel is constructed and arranged to actively cool the venturi mixer via an active cooling system.

13. A product as set forth in claim 12, wherein:

the EGR-mixer system further comprises a reservoir, the reservoir comprising an inlet, a fluid reservoir, and a pump; and wherein the reservoir is constructed and arranged to receive condensate from the venturi mixer and flow said condensate to at least one portion of a motor vehicle to actively cool or heat that portion of the motor vehicle.

14. A product as set forth in claim 12, wherein:

the venturi mixer being constructed and arranged to facilitate passive cooling of the venturi mixer and condensation of liquid from the exhaust gas and air mixture as said mixture flows through the through-channel of the venturi mixer.

15. A product as set forth in claim 12, wherein:

the first housing defines both the second housing and the third housing and is constructed and arranged such that the first housing, second housing, and third housing are of a single piece construction.

* * * * *